United States Patent [19]

Duchenaud et al.

[11] 4,050,409

[45] Sept. 27, 1977

[54] CYLINDER FOR REPRODUCING RAISED PATTERNS ON ALL SURFACES

[76] Inventors: Alain Duchenaud; Roger Duchenaud, both of 3 rue de Funas, Bourgoin Jallieu (Isere), France

[21] Appl. No.: 512,725

[22] Filed: Oct. 7, 1974

[30] Foreign Application Priority Data

Oct. 24, 1973 France ..... 73.38567

[51] Int. Cl.[2] ..... B05C 1/16

[52] U.S. Cl. ..... 118/406; 101/116

[58] Field of Search ..... 118/406, 213, 504, 505, 118/407, 419; 427/282; 101/116, 128.4

[56] References Cited

U.S. PATENT DOCUMENTS

| | | | |
|---|---|---|---|
| 1,636,546 | 7/1927 | Bates et al. | 101/128.4 |
| 2,287,122 | 6/1942 | Norris | 101/128.4 UX |
| 2,333,382 | 11/1943 | Kent | 118/406 UX |
| 2,698,574 | 1/1955 | Dougherty et al. | 118/213 X |
| 2,906,201 | 9/1959 | Blair, Jr. | 101/116 |
| 2,928,340 | 3/1960 | Stein et al. | 118/406 UX |
| 3,133,312 | 5/1964 | Harris et al. | 118/213 X |
| 3,343,504 | 9/1967 | Beik | 118/406 UX |
| 3,613,635 | 10/1971 | Brehm | 118/406 |
| 3,735,730 | 5/1973 | Mitter | 118/213 X |

*Primary Examiner*—Mervin Stein

*Attorney, Agent, or Firm*—Irving M. Weiner; Pamela S. Austin

[57] ABSTRACT

An apparatus for imparting a relief effect to patterns on even surfaces. A cylinder is formed by winding upon itself a thick metal sheet which is provided with holes therethrough. A doctor permits the depositing of a coat of a colorless varnish onto the surface to be coated when the surface is translated linearly relative to the rotatable cylinder.

12 Claims, 6 Drawing Figures

CYLINDER FOR REPRODUCING RAISED PATTERNS ON ALL SURFACES

The present invention relates to an apparatus and the making of a cylinder for reproducing raised patterns on all surfaces and supports.

BACKGROUND OF THE INVENTION

It is known that for reproducing a pattern on a support, a series of cylinders may be used, each cylinder comprising a metal sheet rolled upon itself, in which a very great number of fine pores are drilled. Each cylinder is intended to reproduce only one color of the pattern. To this end, the pores are obturated at the locations where the color to which the cylinder corresponds should not appear. Then, the cylinder is applied on the surface to be treated, in a manner such that the contact takes place along one of the generatrices of the cylinder. Lastly, the article and the cylinder are set in motion so that the surface of the latter is developed on the surface to be treated, while a doctor allows making the coloring matter to pass through the pores, so that said coloring matter is deposited on the article.

In a general way, the colored coats deposited are very thin, so as to limit the drying time as much as possible. However, this method has a drawback in that it cannot be used to impart an effect of relief to the pattern.

An object of the invention is to obviate said drawback by providing a method for imparting an effect of relief to the pattern, and a cylinder for producing said effect.

SUMMARY OF THE INVENTION

The present invention provides a method of imparting relief to a pattern on a surface, comprising the step of depositing a substantially thick layer of flowable material on only those preselected portions of the pattern which are to be raised.

The present invention also provides an apparatus for carrying out the aforestated method, wherein the apparatus comprises a first cylinder for selectively depositing on the surface a first predetermined pattern of a first flowable material having a first color. The apparatus also includes a second cylinder for selectively depositing on the surface a second predetermined pattern of a second flowable material having a second color. The apparatus also includes a third cylinder for selectively depositing on the surface a third predetermined pattern of a third flowable material having a third color. The apparatus also includes a fourth cylinder for selectively depositing on the surface a fourth predetermined pattern in a substantially thick layer of varnish to only those preselected portions of the pattern which are to be raised.

A method according to the invention for imparting an effect of relief to patterns drawn on a even surface, in particular on the surfaces of products intended to cover the floors, is characterized in that it consists in covering the portions of the patterns, to which an effect of relief is to be imparted, with a thick layer of colorless varnish or any other material.

According to another feature of the method, depositing the coat of varnish is effected in a single operation by means of a cylinder and a doctor, the varnish passing through holes drilled through the wall of the cylinder and uniformly distributed over certain areas of the surface of said cylinder, said areas being accurately in the shape of the pattern portions to be coated.

A cylinder for putting into practice the method according to the invention may consist of a metal sheet wound on itself, and is characterized in that said sheet has a thickness greater than that of the sheets used for reproducing a color, while the surface of the sheet includes areas which are impervious to the varnish, and at least some areas which are provided with holes evenly distributed, which holes are greater than those used for reproducing a color.

According to a further feature of the invention, the periphery of each hole is defined by a wire-like metal portion, the cross-section of which is smaller than the surface of the hole, which ensures that the coat of varnish will be continuous, as the wire portions leave no mark.

According to a further feature of the invention, the peripheries of the holes are polygonal in shape, and the diameter of the circle inscribed in each hole is greater than 1 millimeter.

According to a further feature of the invention, the areas which are impervious to the varnish consist of solid metal. The cylinder is therefore manufactured according to order, that is, it can only be used for one pattern.

According to a modified embodiment, the whole area of the metal sheet is evenly perforated, while the areas impervious to the varnish are obtained by obturating the corresponding holes, in which case the cylinder can be used for several patterns. As a matter of fact, it is only necessary to modify the shapes of the areas the holes of which are obturated.

A product produced by carrying the method of the invention into practice is characterized in that its surface includes raised areas, said areas being constituted by a substantially thick coat of colorless varnish or of any other deposited matter.

According to another feature of said product, the latter is used in any decorative application, such as, for instance, covering a floor, walls, or the like.

BRIEF DESCRIPTION OF THE DRAWINGS

The accompanying drawing, which is given by way of non-limiting example, will enable understanding the features of the invention more clearly.

DETAILED DESCRIPTION

Figure 1:
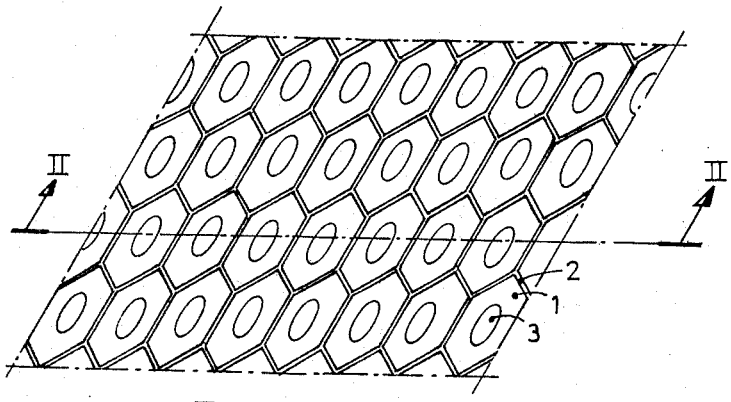
FIG. 1 is a view of the top surface of a product according to the invention.

FIG. 1 shows the top surface of a product according to the invention. The "tiles" 1 are separated from each other by joints 2, and are each provided with a central circular decorative portion 3. These various elements have different colors. For instance, the joints 2 are white, the "tiles" 1 are red, and the decorative portions 3 are green.

Figure 2:
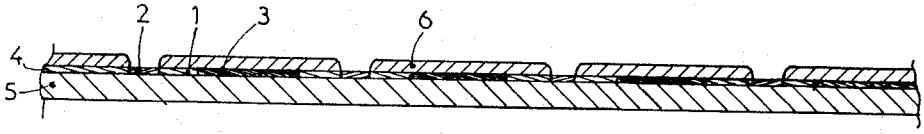
FIG. 2 is a sectional view of said product taken along line II—II of FIG. 1.

The patterns are obtained by means of a layer 4 deposited on the surface of a support 5 (FIG. 2). This support 5 may consist, of instance, of a product sold under the commercial name "BALAFLOOR." The layer 4 shows areas which are respectively colored in white, in red, or in green, according as they correspond to a joint 2, a "tile" 1, or a decorative portion 3, respectively.

The product is characterized in that the "tiles" 1 show an effect of relief. This effect is obtained by depositing a discontinuous layer 6 of a flowable material, such as colorless varnish, which layer covers only the "tiles" 1.

The effect of relief is produced as a result of the fact that the layer 6 of varnish seems to make part of the tiles 1, as it seems to have the same color as said tiles.

Figure 5:
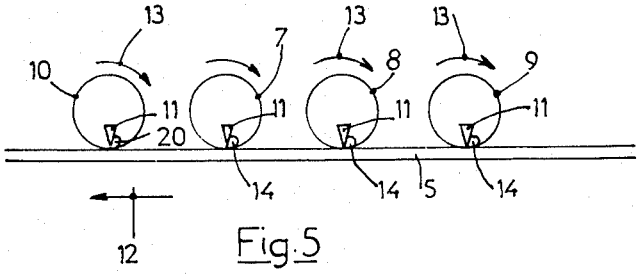
FIG. 5 is a diagrammatic view of a plant provided with a cylinder according to the invention.

The first layer 4 is laid in a known way, by means of three cylinders 7, 8 and 9, as shown in FIG. 5. The first cylinder 9, for instance, allows laying down the white colored matter for the joints 2, while the second cylinder 8 is used for the red colored matter for the tiles 1, and the third cylinder 7 for the green colored matter for the decorative portions 3. Each of said cylinders consists of a metal sheet rolled upon itself, in which a very great number of fine pores are drilled. These pores are obturated at the locations where the coloring matter should not appear. Then, the coloring matter is disposed inside the cylinder, and the latter is applied on the surface of the product to be treated, in a manner such that the contact takes place along one generatrix of the cylinder. Lastly, the product is set in motion in the direction of the arrow 12, and drives the cylinders with it, said cylinders starting to revolve in the direction of the arrows 13, while a doctor 11, which is provided inside each cylinder, pushes down the coloring matter 14 through the pores. Said coloring matter is thus deposited on the product 5. The thickness of the layer 4 laid down by the cylinders 7, 8 and 9 is very small, so as to reduce the drying time to a minimum.

Figure 3:
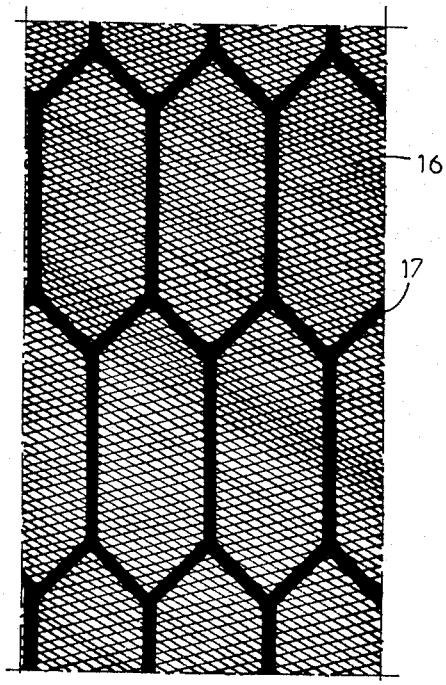
FIGS. 3 and 4 are detail views of the surface of the cylinder by means of which the product of FIG. 1 is produced.
Figure 4:
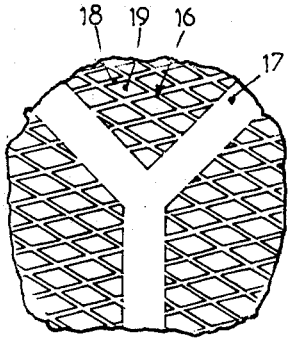

In order to obtain an effect of relief, an additional fourth cylinder 10 is provided after the cylinders 9, 8 and 7. The wall of the cylinder 10 includes, as in the previous cylinders, evenly perforated areas 16 (FIGS. 3 and 4), and areas 17 which are impervious to the varnish. The holes in the areas 16 are greater than the pores used for reproducing a color. The periphery of each of said holes is defined by a wire-like metal portion 18, the cross-section of which is smaller than the area 19 of each hole. The holes are preferably polygonal in shape. In the case illustrated in FIG. 4, said holes are in the shape of parallelograms, the inscribed circles of which each have a diameter greater than 1 millimeter.

The areas 17 impervious to the varnish consist of solid metal.

The perforated areas 16 have the same shape as the "tiles" 1.

The metal sheet which forms the cylinder 10 has a thickness 21 (FIG. 6) greater than the thickness of the metal sheets used for forming the cylinders 7, 8 and 9.

Figure 6:
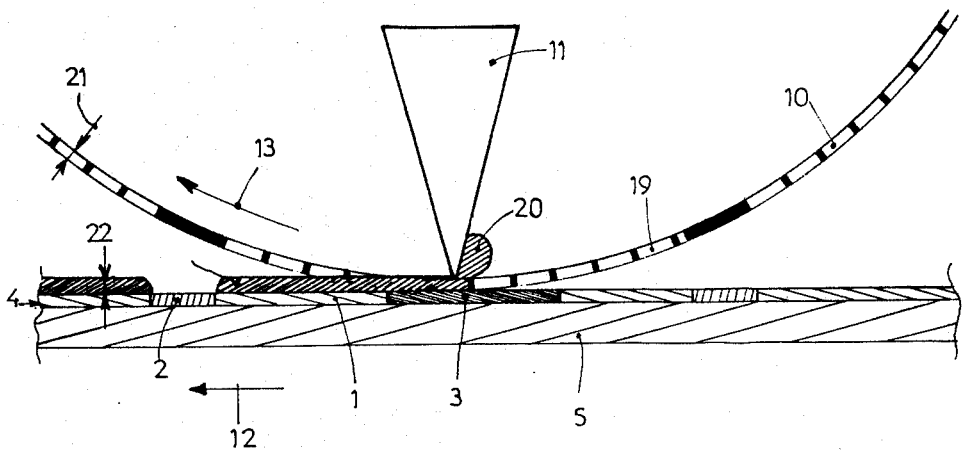
FIG. 6 is a view illustrating the way a cylinder according to the invention is used.

A cylinder 10 according to the invention is used as follows:

The cylinder 10 is put in contact, along one of its generatrices, with the support product 5 to be treated, in the same way as was done previously for the cylinders 7, 8 and 9. Colorless varnish is then introduced in the cylinder 10, and pushed back by a doctor 11. The product 5 thus drives the cylinder 10 in the direction of the arrow 13, while the doctor 11 pushes back the varnish 20 through the holes 19, as shown in FIG. 6. A layer 6 of colorless varnish, or any other material, is thus deposited, the thickness 22 of which is greater than that of the layer 4. Said layer 6 is discontinuous, and covers only the "tiles" 1 and the decorative portions 3 of the latter, while the joints 2 are left directly visible.

The varnish layer 6 gives the effect of relief wanted, as it appears of the same color of the tiles 1, and seems therefore to make part of said tiles.

According to a modified embodiment of the invention, the whole area of the metal sheet which forms the cylinder 10 is evenly perforated, while the areas 17 are obtained by obturating the corresponding holes by means of a suitable material.

An essential advantage of the invention lies in the fact that it is possible to apply a very thick layer of colorless varnish, or some other material, which layer gives an effect of relief.

We claim:

1. An apparatus for imparting relief to a pattern on a surface, comprising, in combination:

a first cylinder, containing a doctor therein, for selectively depositing on said surface a first predetermined pattern of a first flowable material having a first color;

a second cylinder, containing a doctor therein, for selectively depositing a second predetermined pattern, which is different than said first predetermined pattern, of a second flowable material having a second color which is different than said first color;

a third cylinder, containing a doctor therein, for selectively depositing a third predetermined pattern, which is different than said first predetermined pattern, of a flowable material having a third color which is different than said first color; and a fourth cylinder, containing a doctor therein, for selectively depositing a fourth predetermined pattern, which is different than said first predetermined pattern, of a substantially thick layer of said flowable material on only those preselected portions of said patterns which are to be raised.

2. An apparatus according to claim 1, characterized in that:

said flowable material in said fourth cylinder is varnish;

said fourth cylinder is in the shape of a metal sheet rolled upon itself;

the whole surface of said metal sheet is evenly pierced with holes; and the periphery of each said hole is defined by a wire-like portion, the cross-section of which is smaller than the area of said hole, so that said wire-like portions do not leave any impression after said varnish is applied.

3. An apparatus according to claim 2, characterized in that:

each said hole has a polygonal periphery the size of which is determined by an inscribed circle the diameter of which is greater than one millimeter; and the thickness of said metal sheet is greater than the width of said wire-like portion.

4. An apparatus according to claim 2, characterized in that:

areas of said fourth cylinder are impervious to said varnish on those portions of said fourth cylinder that correspond to those said preselected patterns that are not to be raised, said areas are produced by obturating the corresponding holes by means of a suitable material, in which case the cylinder can be used for several patterns merely by modifying the shapes of the areas the holes of which are obturated.

5. An apparatus according to claim 2, characterized in that:

areas of said fourth cylinder which are impervious to said varnish are made of solid metal; said fourth cylinder being used for one pattern only.

6. An apparatus for imparting relief to patterns on a surface, comprising:

at least one printing cylinder for depositing on said surface predetermined patterns;

said cylinder selectively printing a flowable material with a predetermined color;

at least one special cylinder for selectively depositing a substantial thick layer of product on only preselected areas of said printed surface; and said special cylinder comprising a sheet metal provided with holes and a doctor for depositing a flowable material product which passes through the holes and coats the areas which are to be raised, the relief effect being obtained by the great thickness of said layer which can reach at least 0.5 millimeters.

7. An apparatus according to claim 6, characterized in that:

said special cylinder is in the shape of a metal sheet rolled upon itself;

the thickness of said sheet being greater than that of sheets used for said printing cylinders;

the surface of said sheet includes some areas which are impervious to said product, while other areas are provided with holes;

said holes being larger than those existing in sheets used for said printing of a color; and said product comprises a varnish.

8. An apparatus according to claim 7, characterized in that the periphery of each said hole is defined by a wire-like portion, the cross-section of which is smaller than the area of said hole, so that said wire-like portions do not leave any impression after said varnish is applied.

9. An apparatus according to claim 7, characterized in that each said hole has a polygonal periphery, the size of which is determined by an inscribed circle, the diameter of which is greater than 1 millimeter.

10. An apparatus according to claim 7, characterized in that:

said areas which are impervious to said varnish are made of solid metal; and said cylinder being used for one pattern only.

11. An apparatus according to claim 7, characterized in that the whole surface of said metal sheet is evenly pierced with holes, while said areas impervious to said varnish are produced by obturating the corresponding holes by means of a suitable material, in which case the cylinder can be used for several patterns merely by modifying the shapes of the areas the holes of which are obturated.

12. An apparatus according to claim 6, characterized in that it comprises, in combination:

a first cylinder for selectively depositing on said surface a first predetermined pattern of a first flowable material having a first color;

a second cylinder for selectively depositing a second predetermined pattern which is different than said first predetermined pattern, of a second flowable material having a second color which is different from said first color;

a third cylinder for selectively depositing a third predetermined pattern which is different than said first and second predetermined patterns, of a third flowable material having a third color which is different from said first color; and the special cylinder being a fourth cylinder for selectively depositing a substantially thick layer of a relatively viscous product, such as varnish, on only those preselected portions of said surface which are to be imparted with a relief effect.

* * * * *